United States Patent [19]

Taylor

[11] Patent Number: 4,565,205

[45] Date of Patent: Jan. 21, 1986

[54] MOLDED MASCARA APPLICATOR

[75] Inventor: Charles H. Taylor, West Springfield, Mass.

[73] Assignee: Super Brush Co., Inc., Chicopee, Mass.

[21] Appl. No.: 476,473

[22] Filed: Mar. 18, 1983

[51] Int. Cl.[4] ..... A45D 40/26

[52] U.S. Cl. ..... 132/88.7; 132/85; 15/167 R

[58] Field of Search ..... 132/88.7, 151, 152, 132/88.5, 85; 15/167, 187

[56] References Cited

U.S. PATENT DOCUMENTS

| | | | |
|---|---|---|---|
| 2,007,245 | 7/1935 | Gimonet | 132/88.7 |
| 2,604,105 | 7/1952 | Kruck | 132/88.7 |
| 2,783,490 | 3/1957 | Kutik | 15/187 |
| 3,147,758 | 9/1964 | Elliott | 132/151 |
| 3,302,230 | 2/1967 | Poppelman | 15/187 UX |
| 3,343,551 | 9/1967 | Anderson | 132/88.7 |
| 3,461,886 | 8/1969 | Bau | 132/88.7 |
| 3,855,689 | 12/1974 | Schiffman | 132/151 |
| 3,908,676 | 9/1975 | Levine | 132/88.7 |
| 4,161,050 | 7/1979 | Sasaki | 132/85 |
| 4,187,866 | 2/1980 | Zwiren | 132/151 |
| 4,325,392 | 4/1982 | Iten | 15/187 |

*Primary Examiner*—Gregory E. McNeill

*Attorney, Agent, or Firm*—Steele, Gould & Fried

[57] ABSTRACT

A mascara applicator is disclosed which includes a brush portion having a base and filament-like brush elements of molded plastic material. A plurality of the filament-like brush elements extend at right angles from the base and are integrally molded with the base. The brush elements may be of circular or elliptical cross section configuration of relatively fine dimensions. The elliptical cross section may have a major axis of 0.018 inches and a minor axis of 0.010 inches. The circular cross sectional tines can vary in diameter from approximately 0.014 inches at their bases to approximately 0.005 inches at their tips. In various modifications of the applicator, the base may also be equipped with a plurality of longitudinally spaced wells, with a plurality of longitudinally extending wells and with plurality of short tines.

5 Claims, 25 Drawing Figures

MOLDED MASCARA APPLICATOR

FIELD OF THE INVENTION

This invention relates generally to the field of cosmetic devices, and more particularly, is directed to an improved molded, unitary, mascara applicator.

BACKGROUND OF THE INVENTION

During recent years, the use of eye make-up has received increased emphasis and the application of cosmetics about the eyes, such as mascara, has become increasingly more popular. Applicators which are particularly designed and adapted for applying mascaras to curl, color, comb and lengthen eyelashes have been developed by prior workers in the art. Other applicators which are useful in separating the lashes when combing are also known and have been employed by others in an effort to achieve a more uniform distribution of mascara upon the hairs which comprise the eye lashes.

Brush-like applicators are known and have generally been constructed in the past with suitable bristles. In view of the intended use of the applicators with such fine hairs as found in eyelashes, the applicator bristles had to be of relatively small diameter and length to be effective in the accurate placement and application of mascara upon the lashes.

In order to satisfactorily apply cosmetics such as mascara, prior workers in the art have utilized longitudinally aligned bristles (Montgomery U.S. Pat. No. 3,921,650) or helically arranged bristles or springs (Kingsford U.S. Pat. No. 3,892,248. Molded teeth or tine portions (Spatz U.S. Pat. No. 3,896,823) have also been developed for lash combing purposes. In the case of applicators wherein teeth or tines have been employed, the presently available manufacturing techniques do not permit such teeth or tines to be fabricated of diameter small enough to effectively apply mascara to the eyelashes in a controlled manner. In those instances wherein bristles have been employed for cosmetic application purposes, it has always been necessary to affix such bristles to the wand by employing an additional connector, such as twisted stainless steel wire during the assembly process. The bristles were secured at one end to the twisted wires and the wires could then be affixed to the plastic wand in a relatively easy and reliable manner with known fabrication techniques. Examples of such twisted wires can be found in Montgomery U.S. Pat. No. 3,921,650, Zulberti, U.S. Pat. No. 4,175,574 and Levine, et al U.S. Pat. No. 3,908,676.

Other prior workers in the art have developed mascara applicators that employed circular grooves or reservoirs to provide a mascara storage area immediately adjacent to the bristles. Levine et al., U.S. Pat. No. 3,908,676 is exemplary of such a construction. The circular grooves or reservoirs have served the purpose of providing adequate mascara storage facilities, but have proved to be detrimental in that they tended to group or bunch the lashes together during application, a decidedly unwanted condition.

Until the present time, by utilizing known fabrication and molding equipment and methods, it has not been possible to construct a mascara applicator having integral, small diameter, filament-like molded plastic brush elements cast in the same mold which is employed for fabrication of the wand itself. Also, the need remains to provide a mascara applicator with built in storage facilities that will not group lashes together during the application process.

SUMMARY OF THE INVENTION

The present invention relates generally to the field of mascara applicators, and more particularly, is directed to a mascara brush assembly which is constructed without separate bristles and wherein the brush portion includes a plurality of fine, filament-like brush elements extending from an elongated base and wherein the brush elements and the base are simultaneously cast in a common mold.

The mascara applicator of the present invention preferably affixes to a cylindrical, elongated wand which is secured at one end to a conventional cap. In the preferred embodiment, the cap also serves as an applicator handle. The wand is insertable within a cosmetic storage container and the cap can be threadedly engaged upon the entrance neck of the container in known manner to prevent loss of cosmetic when the applicator is not in use. Preferably, the neck of the container internally is equipped with a resilient wiper of known design, which wiper functions to scrape excess mascara from the periphery of the wand and from the brush automatically as the wand is withdrawn from the container immediately prior to cosmetic application.

The brush portion of the invention is integrally molded or otherwise formed of suitable plastic to provide a unitary construction comprising an elongated base and a plurality of integral, extremely fine, filament-like brush elements which integrally extend outwardly from the base. The filament-like brush elements are considerably smaller in their cross sectional dimensions then heretofore possible to achieve in plastic by employing known plastic molding techniques. In one embodiment, the brush elements are generally elliptical in cross sectional configuration having a major axis of approximately 0.018 inches and a minor axis of approximately 0.010 inches.

In another configuration, the brush elements are fabricated to a round cross sectional configuration having a diameter of approximately 0.014 inches. The round configuration brush elements may be of uniform diameter throughout their length, may be of uniformly decreasing diameter from base to tip or may be of a plurality of stepped, decreasing diameters. In case of uniformly decreasing diameters and stepped decreasing diameter brush elements, it is contemplated that the filament-like brush elements will be fabricated of diameter of approximately 0.014 inches at their connections to the elongated base and will be reduced to approximately 0.005 inches in diameter at their respective ends or tips.

In the preferred embodiment of the invention, all of the brush elements are fabricated to a height or length of approximately 0.180 inches above their respective connections to the base.

In various embodiments of the invention, the elongated base may be molded or otherwise formed to include sidewalls of plain configuration, sidewalls having non-continuous slots, sidewalls having longitudinally extending wells, sidewalls with interrupted, non-continuous slots, and two sided brushes with or without longitudinal wells formed in the sidewalls. The longitudinal wells comprise lenthwise grooves for mascara storage purposes. In view of the fact that the storage grooves extend in a direction at right angles to the direction of mascara application, there is a tendency to maintain the lashes separate during application so that the mascara may be applied without grouping lashes together.

In the case of two sided brushes, the brush elements of the respective sides extend in diametrically opposite directions and are simultaneously integrally molded or otherwise formed with the base. Preferably, the brush elements on one side are longer in length than the brush elements on the opposite side for optimum mascara application and eyelash combing purposes.

It is therefore, object of the present invention to provide an improved molded mascara applicator of the type set forth.

It is another object of the present invention to provide a mascara applicator including a brush comprising an elongated base and a plurality of extremely fine, integrally molded brush elements outwardly from the base.

It is another object of the present invention to provide a novel mascara applicator that comprises a unitary, elongated base, and two oppositely disposed brush portions integrally extending from the base, each of the brush portions comprising a plurality of filament-like brush elements, which elements are simultaneously molded with the base and which brush elements are of uniform cross sectional configuration throughout their length.

It is another object of the present invention to provide a novel mascara applicator which comprises an elongated, molded plastic base, a brush portion including a plurality of small, filament-like brush elements integrally extending from the base portion, the brush elements being of generally elliptical, cross sectional configuration.

It is another object of the present invention to provide a mascara applicator which comprises a molded, elongated base, at least one brush portion integrally formed with the base and comprising a plurality of filament-like brush elements, the brush elements being of non-uniform cross sectional configuration, the cross sectional dimensions of the brush elements decreasing in size as the brush elements extend away from the base.

It is another object of the present invention to provide a novel mascara applicator that includes a brush portion that is unitary in construction and comprises filament-like brush elements which are capable of being cast in a common mold during manufacture.

It is another object of the present invention to provide a novel mascara applicator that comprises a molded, elongated base, a brush means integrally formed with the base and comprising a plurality of filament-like brush elements and a plurality of longitudinally aligned grooves in the base for mascara storage and application in a manner that would tend to keep the lashes separate.

Other objects and fuller understanding of the invention will be had by referring to the following description and claims of a preferred embodiment thereof, taken in conjunction with the accompanying drawings wherein like reference characters refer to similar parts throughout the several views and in which:

DESCRIPTION OF THE PREFERRED EMBODIMENT OF THE INVENTION

Figure 2:
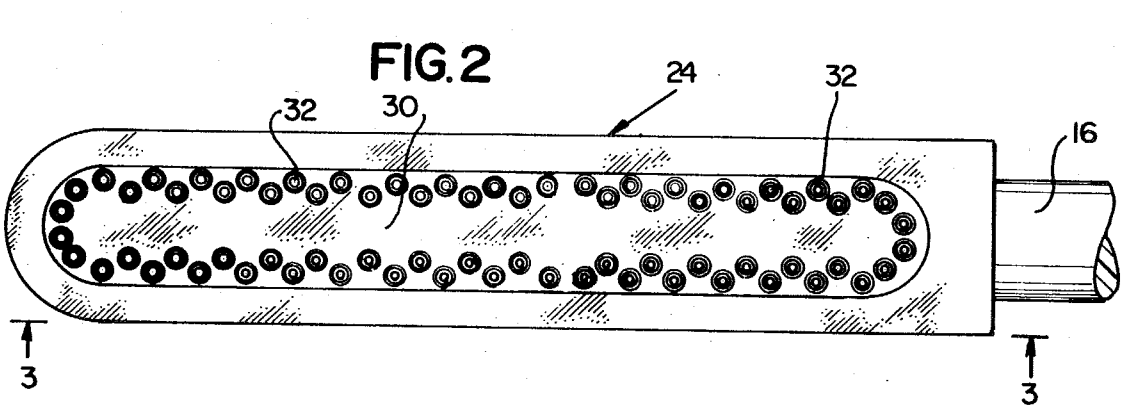
FIG. 2 is a top plan view of one embodiment of an applicator brush.

Although specific terms are used in the following description for the sake of clarity, these terms are intended to refer only to the particular structure of the invention selected for illustration in the drawings and are not intended to define or limit the scope of the invention.

Figure 1:
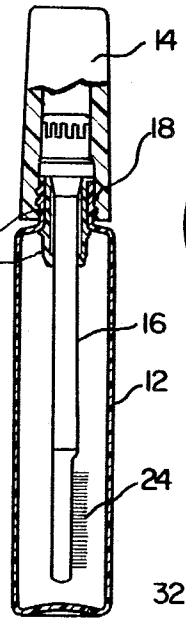
FIG. 1 is a side elevational view of a mascara applicator package constructed in accordance with the present invention, reduced in size and partially broken away to expose interior construction details.

Referring now to the drawings, there is illustrated in FIG. 1 a mascara applicator package generally designated 10 that comprises a bottle or tubular container 12, a plastic or other material cap or applicator means 14 and an applicator wand or shaft 16. In the usual manner, the bottle 12 terminates upwardly in a threaded neck 18 to threadedly receive the interior threads 20 which are conventionally formed in the cap 14. In known manner, a resilient wiper 22 that is adapted to seal against the outer periphery of the wand 16 is retained within the container neck 18. The wiper 22 functions to both wipe excess mascara (not illustrated) from the wand and to fill the slots and comb tines of the brush portion 24 as the brush is withdrawn from the bottle or container 12. As illustrated, the brush 24 connects at the bottom of the wand 16 in any suitable, well known manner to prevent inadvertent separation of the parts upon use.

Figure 3:
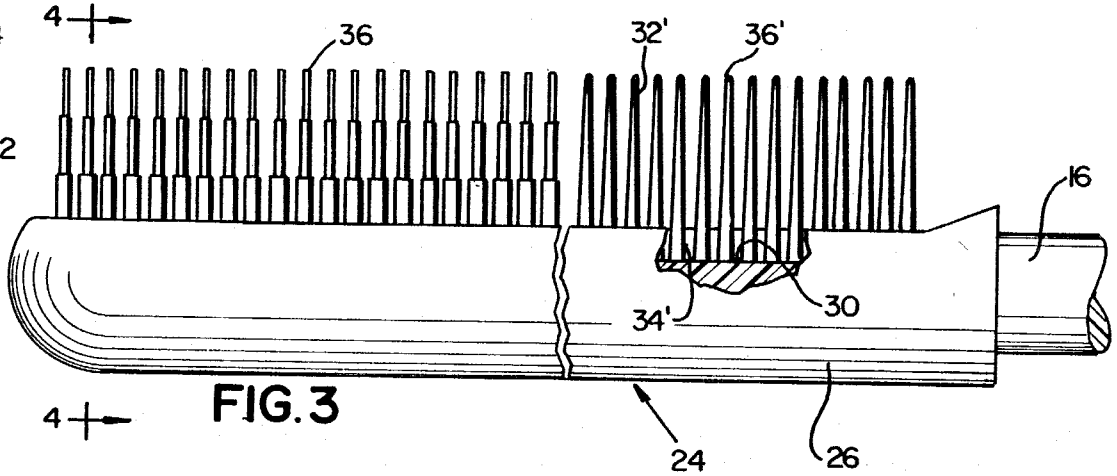
FIG. 3 is a side elevational view of the applicator brush of FIG. 2, looking from line 3—3, and illustrating two possible brush element configurations.
Figure 4:
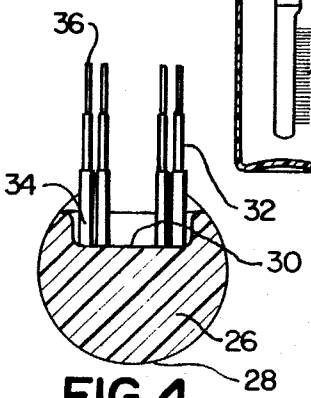
FIG. 4 is a cross sectional view taken along line 4—4 of FIG. 3, looking in the direction of the arrows.

Referring now to FIGS. 2, 3 and 4, there is illustrated one embodiment of a brush 24 which comprises generally a molded integral, plastic, elongated base 26 having a round bottom 28 and a relatively flat, elongated top surface 30.

A plurality of very fine diameter, filament-like brush elements or tines 32, 32' are integrally formed with the base 26 and rise from the flat top surface 30 at right angles to the longitudinal axis of the base 26.

As illustrated at the left side of FIG. 3 and in FIG. 4, the brush elements or tines 32 may be fabricated with stepped, decreasing diameter segments from the respective tine bases 34 to the tine tips 36. As an example of the extremely fine tines contemplated in accordance with the present invention, the base 34 of each tine 32 is preferably fabricated by precise molding techniques to a diameter of between 0.010 and 0.013 inches. The tine tips 36 are preferably molded to a diameter of approximately 0.005 inches. In the embodiment illustrated at the right side of FIG. 3, the tines 32' are not fabricated of stepped configuration, but rather, uniformly taper from the respective bases 34' to the respective tips 36' to form elongated, slender, conical configurations. The tapered tines 32' follow the same general dimensions as the stepped tines 32 and taper uniformally from a base diameter of approximately between 0.010 inches and 0.013 inches. The tines 32' terminate in relatively fine diameter tips 36' of approximately 0.005 inches. In the illustrated embodiment, the tines 32, 32' extend in length from the base top surface 30 a distance of approximately 0.180 inches.

As above set forth, the tines 32, 32' are integrally formed with the molded plastic base 26 and are fine enough and strong enough to be employed both for combing the eyelashes and for initially storing and applying liquid mascara to the eyelashes. It is noted that the brush elements or tines 32, 32' of this embodiment extend from one side only of the base 26 and accordingly, the tines serve the dual purposes of combing the eyelashes and the application of liquid cosmetic to the eyelashes.

In the embodiment illustrated in FIGS. 5, 6, 7 and 8, a two sided brush 38 is illustrated which comprises generally a molded, elongated, integral, plastic base 40, which base is suitably formed to provide a flat top surface 42 and flat bottom surface 44. As illustrated, two rows of elongated tines 46, 46' integrally extend from the flat top surface 42 at right angles to the longitudinal axis of the base 40 for eyelash combing purposes. The long tines 46, 46' are of uniform cross section throughout their length and preferably are fabricated to an extremely small, elliptical cross-sectional configuration for optimum strength and eyelash combing purposes. In the embodiment illustrated, it is contemplated that the major axis of the elliptical cross section of each long tine 46, 46' will be preferably be on the order of 0.018 inches and the minor axis of the elliptical cross sectional configuration will be on the order of approximately 0.010 inches. The major axes of the long tines extend at right angles to the longitudinal axis of the base 40. As above set forth, the long tines 46, 46' are integrally formed with the base 40 and are therefore secured therein without the need for any external construction members, such as twisted wires, adhesives, or the like. The length or height of each long tine 46, 46' will be approximately 0.180 inches.

Figure 5:
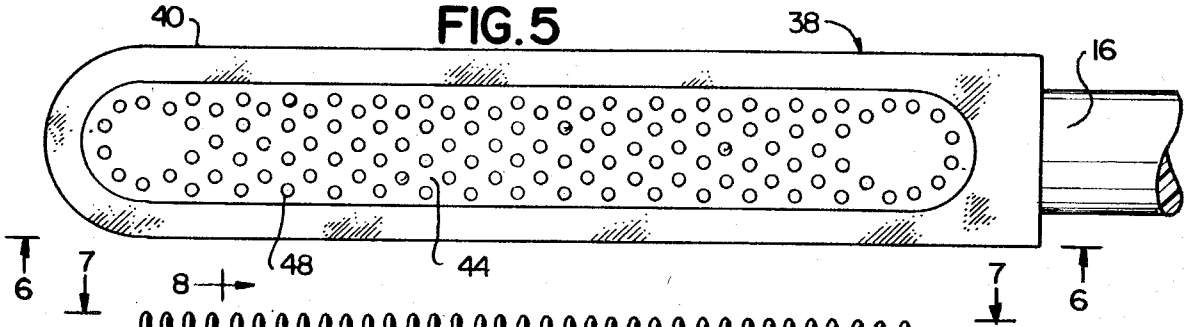
FIG. 5 is a bottom plan view of another embodiment of an applicator brush.
Figure 6:
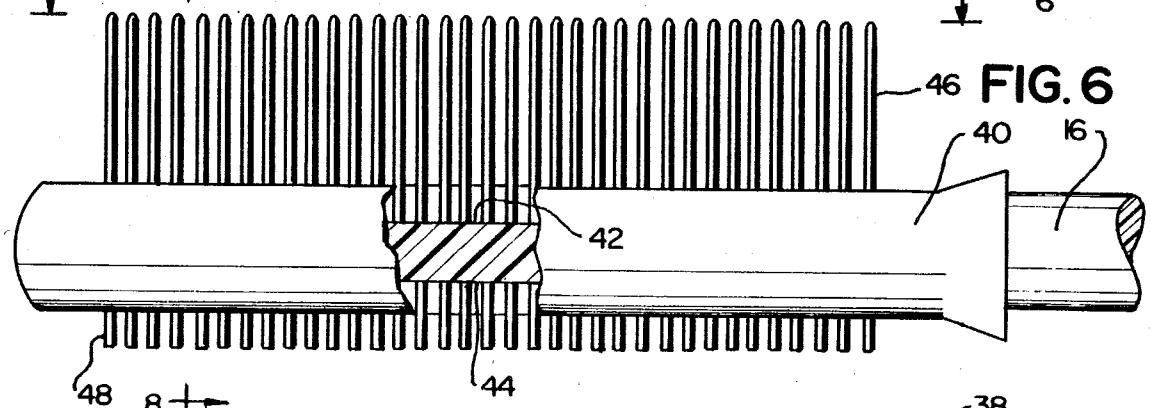
FIG. 6 is a side elevational view of the brush of FIG. 5, looking from line 6—6, and partially broken away to expose interior construction details.
Figure 7:
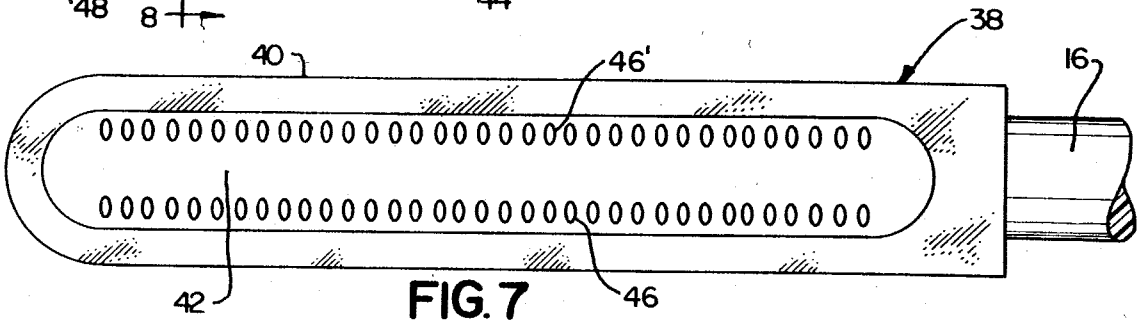
FIG. 7 is a top plan view of the brush of FIG. 5, looking from line 7—7 on FIG. 6.
Figure 8:
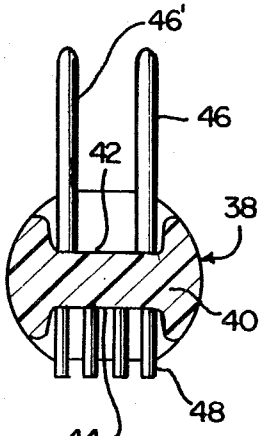
FIG. 8 is a cross sectional view taken along line 8—8 on FIG. 6, looking in the direction of the arrows.

Still referring to FIGS. 5, 6 and 8, a plurality of short tines 48 are randomly positioned on the base 40 and integrally extend downwardly from the flat bottom surface 44 to provide a suitable molded brush for the application of liquid mascara to the eyelashes. The short tines 48 are preferably integrally molded with the plastic base 40 and extend downwardly at right angles to the longitudinal axis of the base. Preferably, the short tines 48 are fabricated of uniform cross sectional configuration and of very fine diameter, for example, a diameter of approximately 0.010 inches. The short tines 48 extend in length a distance suitable for both storing and then applying liquid cosmetic, for example, a length of approximately 0.060 inches. In the embodiment illustrated in FIGS. 5–8, the two rows of long tines 46, 46' are utilized for eyelash combing purposes and the randomly positioned short tines 48 are utilized for the application of liquid mascara to eyelashes, simply by turning the wand 16 through one hundred and eighty degrees between the liquid application and eyelash combing procedures.

Figure 9:
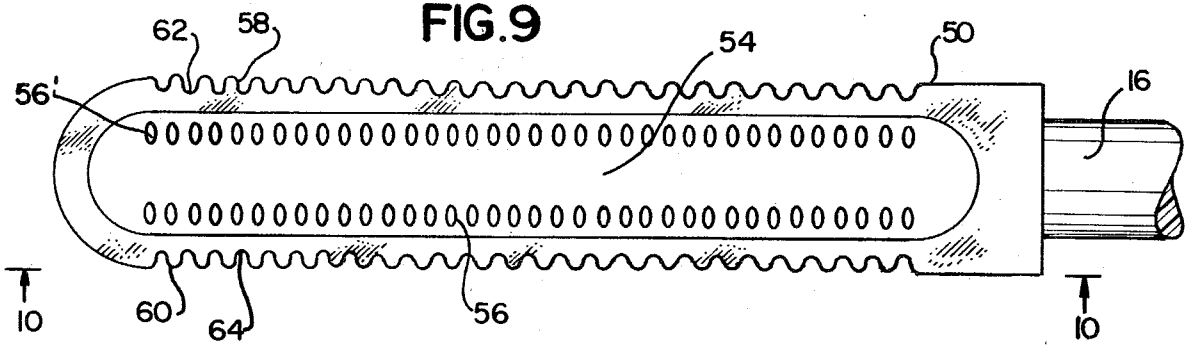
FIG. 9 is a top plan view of another embodiment of a mascara applicator brush.
Figure 10:
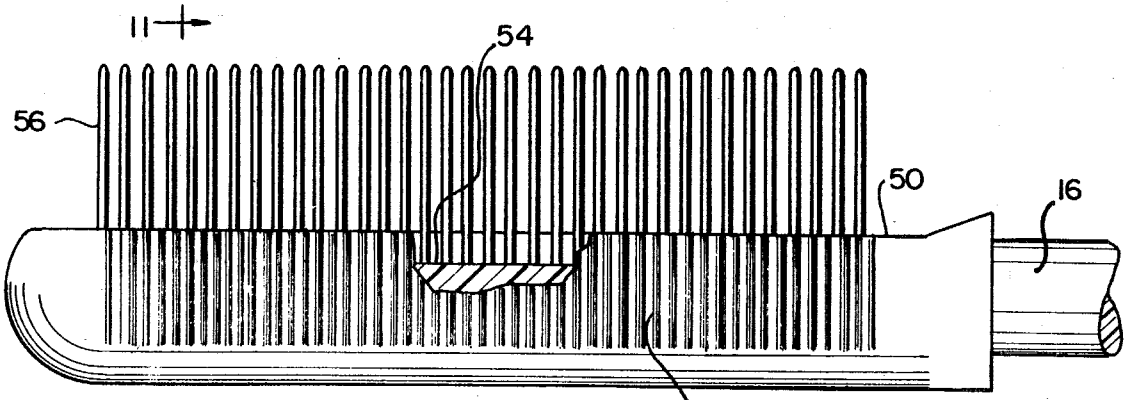
FIG. 10 is side elevational view of the brush of FIG. 9, looking from line 10—10, and partially broken away to expose interior construction details.
Figure 11:
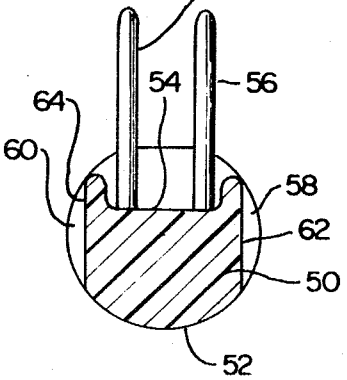
FIG. 11 is a cross sectional view taken along line 11—11 on FIG. 10, looking in the direction of the arrows.

In the embodiment illustrated in FIGS. 9, 10, and 11, a modified molded plastic base 50 is illustrated which is formed with a generally rounded bottom 52 and an elongated, flat top surface 54. As best seen in FIGS. 9 and 11, two rows of long tines 56, 56' are integrally formed with and extend at right angles from the elongated flat top surface 54. Preferably, the long tines 56, 56' are simultaneously molded and integrally extend from the base 50 in a manner whereby additional fastening devices, such as twisted wires, will not be required. The long tines 56, 56' are similar in configuration and dimensions to the long tines 46, 46' illustrated in FIGS. 7 and 8 and are fabricated with an elliptical cross sectional configuration having a major axis of approximately 0.018 inches, a minor axis of approximately 0.010 inches and a total height of approximately 0.180 inches.

Still referring to FIGS. 9 and 11, it will be seen that the molded plastic base 50 is provided with a plurality of longitudinally spaced, non-continuous, arcuate slots 58, 60, which slots are formed on diametrically opposed sides of the base 50. Preferably, the slots are formed of non-continuous configuration and terminate inwardly in slot vertical walls 62, 64, which walls 62, 64 are oriented in planar alignment with the long tines 56, 56'. The arcuate slots 58, 60 terminate at the rounded base bottom 52 and function in unison to form a plurality of longitudinally spaced, opposed reservoirs for storing and applying liquid mascara to the eyelashes (not shown) of the user. The two rows of long tines 56, 56' are employed for eyelash combing purposes. It will be appreciated that the base 50 may be rotated about the longitudinal axis for mascara application purposes by turning the wand 16 through one hundred and eighty degrees. The tines 56, 56' can then be utilized for combing by rotating the wand 16 through ninety degrees from the application position of either the slot 58 or the slot 60.

Figure 12:
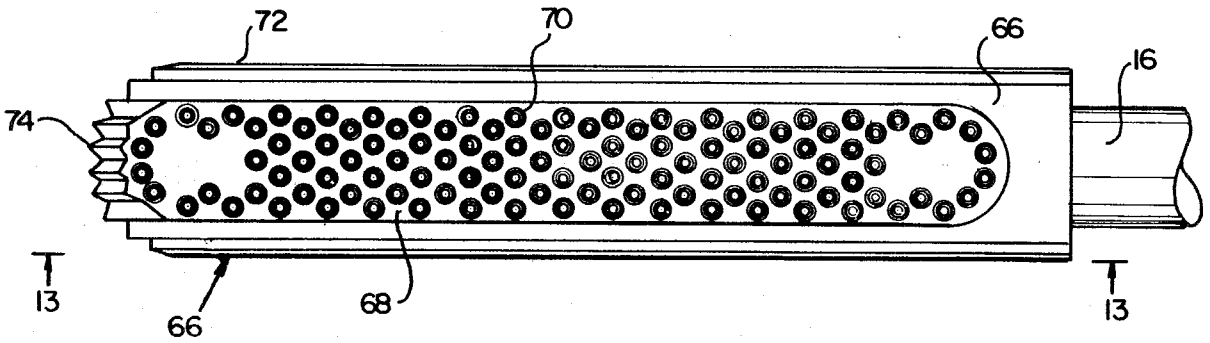
FIG. 12 is a top plan view of another embodiment of a mascara applicator brush.
Figure 13:
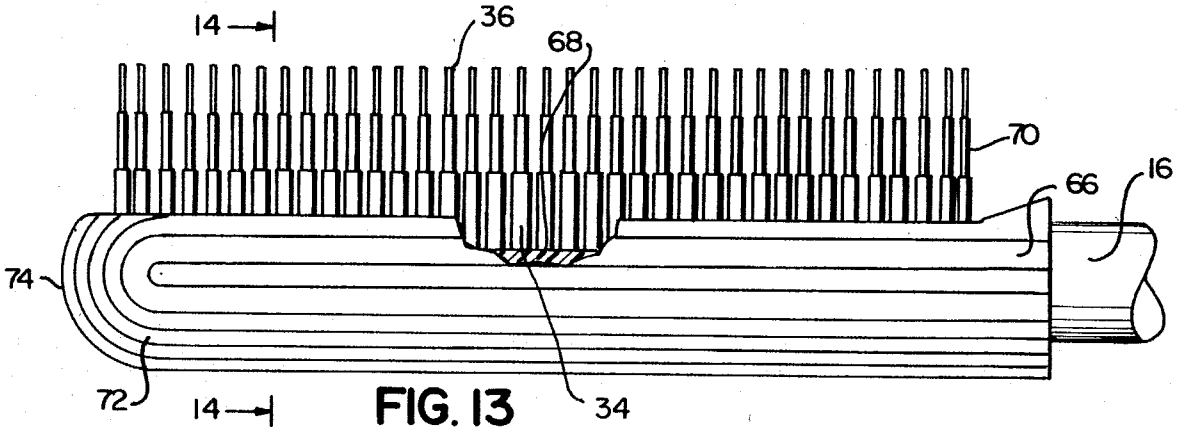
FIG. 13 is a side elevational view of the brush of FIG. 12, looking from line 13—13 and partially broken away.
Figure 14:
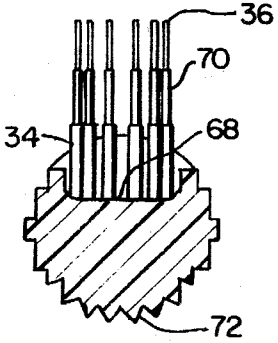
FIG. 14 is a cross sectional view taken along line 14—14 on FIG. 13, looking in the direction of the arrows.

Turning now to FIGS. 12, 13, 14, another embodiment of a mascara applicator is illustrated which includes a modified, molded plastic base 66 which is securely affixed to the applicator wand 16 in the usual manner. The base 66 is molded to form an elongated, flat top surface 68 and plurality of randomly positioned long tines 70, which tines randomly integrally extend from the top surface 68 at right angles to the longitudinal axis of the base 66 for eyelash combing purposes. The tines 70 may be similar in configuration and size to the tines illustrated in FIG. 3 and accordingly, vary in diameter at the base 40 of approximately 0.010 to 0.013 inches to the tip 36 of approximately 0.005 inches. The tines preferably extend in length or height above the flat surface 68 approximately 0.180 inches for eyelash combing purposes.

As illustrated, the molded plastic base 66 is provided with longitudinally extending wells 72, which wells are positioned generally about the periphery of the base and continue without interruption about the round forward end 74 of the base 66. In the embodiment of FIGS. 12, 13 and 14, the long stepped or tapered tines 70 (only one configuration being illustrated) are utilized for combing the eyelashes prior to application. The longitudinally extending wells 72 are utilized as reservoirs when the base 66 is withdrawn from the bottle 12 for storing a quantity of liquid mascara and are then utilized for the application of the liquid mascara directly to the eyelashes by suitably manipulating the wand 16. The longitudinal orientation of the wells 72 is preferable in that there is a built in tendency to keep the lashes separated during the mascara application procedures.

Referring now to FIGS. 15, 16, 17 and 18, a modified, molded plastic base 76 is illustrated and which is attached at the end of a wand 16 in the usual manner. The base is formed with a rounded bottom 78 and elongated flat top surface 80. The flat top surface 80 is provided integrally with two rows of long, elliptical cross-sectional tines 84, 84', which tines may be similar in dimensions and configuration to the tines illustrated in FIGS. 7 and 8 and in FIGS. 9 and 11.

Figure 18:
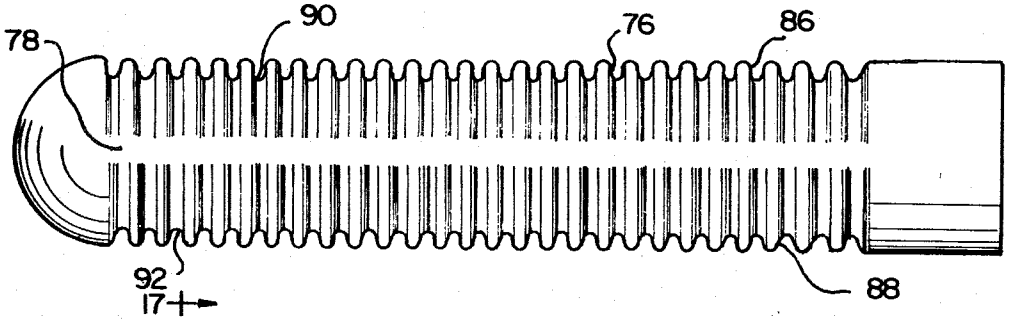
FIG. 18 is a bottom plan view of the applicator brush of FIG. 15, looking from line 18—18 on FIG. 16.
Figure 16:
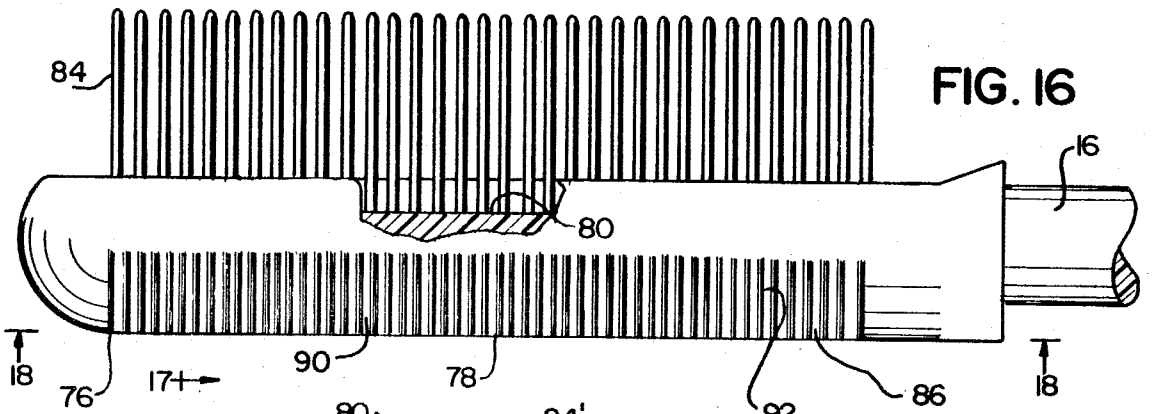
FIG. 16 is a side elevational view of the brush of FIG. 15, looking from line 16—16 and partially broken away.
Figure 15:
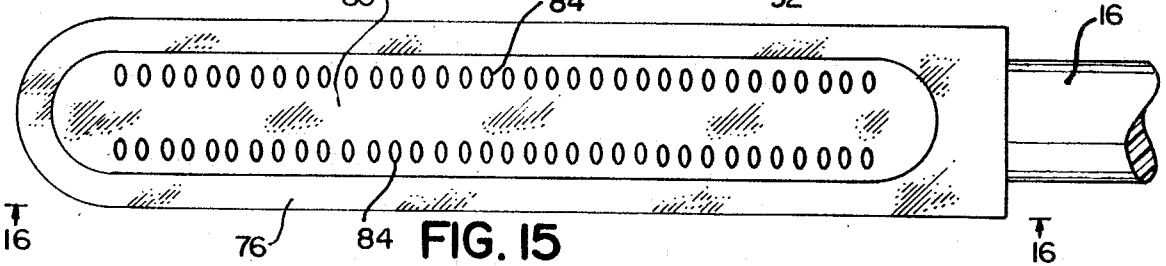
FIG. 15 is a top plan view of another embodiment of a mascara applicator brush.
Figure 17:
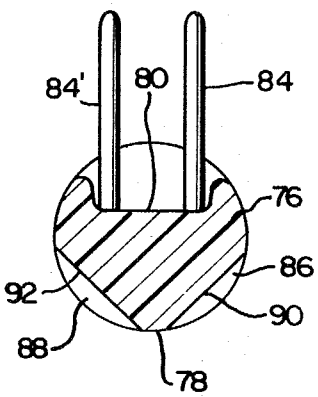
FIG. 17 is a cross sectional view taken along line 17—17 on FIG. 16, looking in the direction of the arrows.

As best seen in FIGS. 17 and 18, the periphery of the molded plastic base 76 is provided with a plurality of longitudinally spaced, bottom positioned, non-continuous slots 86, 88 for liquid cosmetic storage and application purposes. The slots 86, 88 extend along the length of the base 76 and are angularly oppositely arranged from the flat surface 80. Each of the plurality of slots 86, 88 terminates inwardly in an angularly positioned chord 90, 92 to provide a plurality of pairs of oppositely positioned, angularly offset reservoirs. The reservoirs remove a measured quantity of mascara from the bottle 12 when the wand 16 is withdrawn for application to the eyelashes. As best seen in FIG. 17, the chords 90, 92 are formed to extend at right angles to each other.

Figure 19:
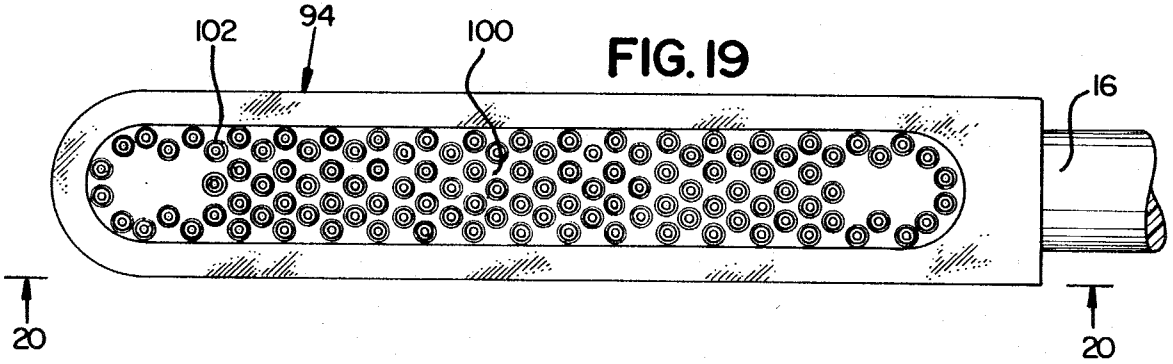
FIG. 19 is a top plan view of another embodiment of a mascara applicator.
Figure 20:
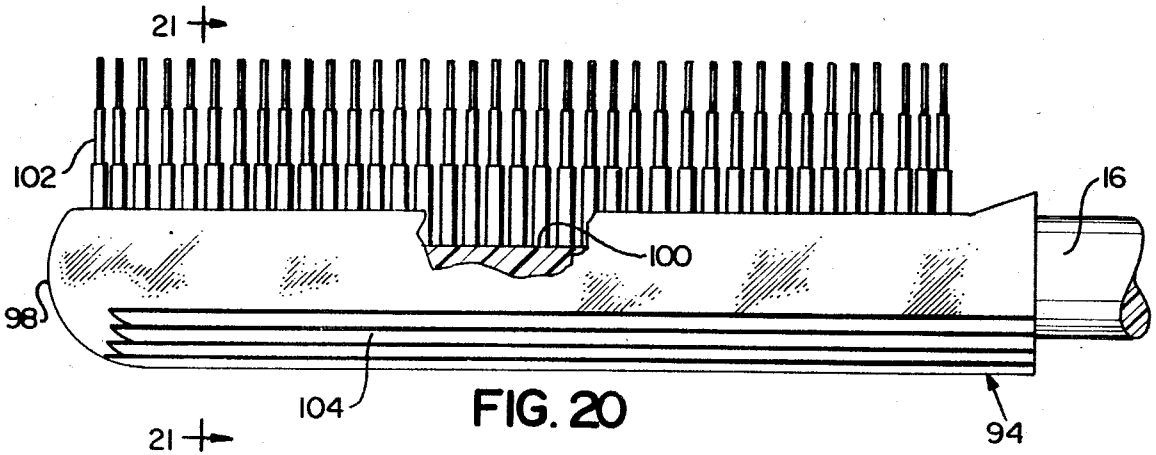
FIG. 20 is a side elevational view of the applicator brush of FIG. 19, looking from line 20—20 and partially broken away.
Figure 21:
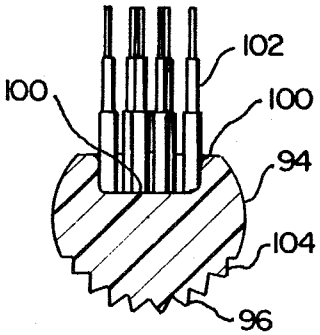
FIG. 21 is a cross sectional view taken along line 21—21 on FIG. 20, looking in the direction of the arrows.
Figure 22:
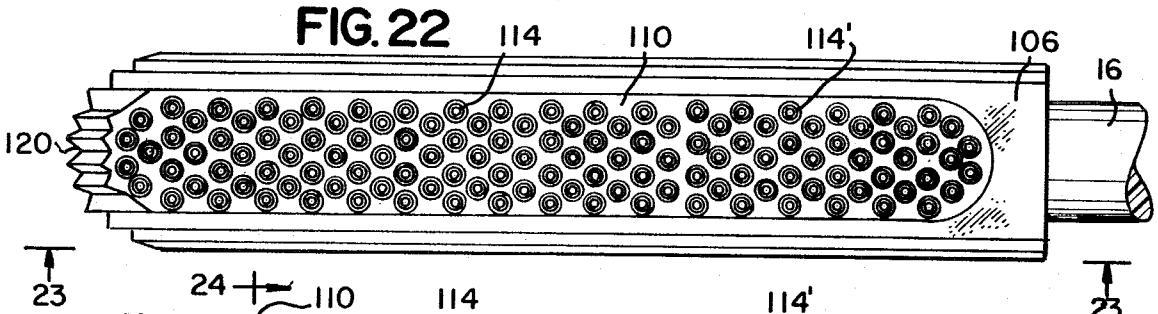
FIG. 22 is a top plan view of another embodiment of a mascara applicator.
Figure 23:
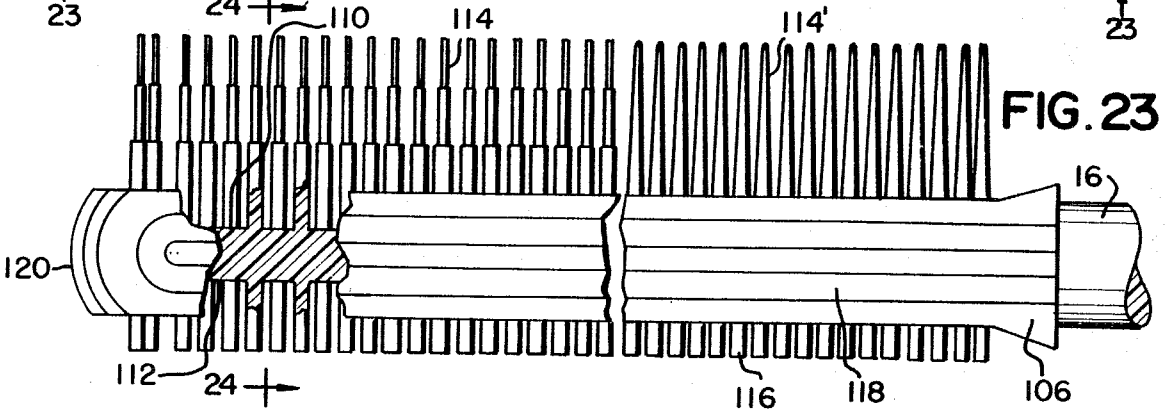
FIG. 23 is a side elevational view of the brush of FIG. 22, looking from line 23—23 and partially broken away, and illustrating two possible brush element configurations.
Figure 25:
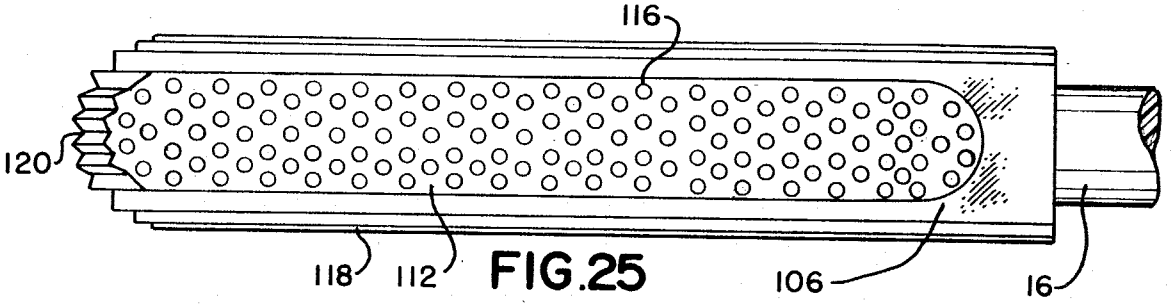
FIG. 25 is a bottom plan view of the brush of FIG. 22, looking from line 25—25 on FIG. 24.
Figure 24:
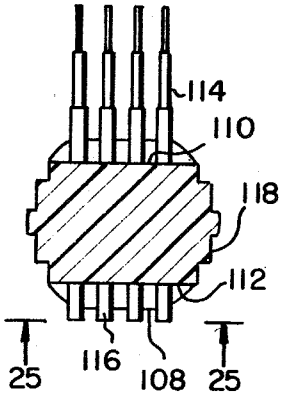
FIG. 24 is a cross sectional view taken along line 24—24 on FIG. 23, looking in the direction of the arrows.

Referring now to FIGS. 19, 20, 21, another embodiment of a mascara brush is illustrated wherein a molded plastic base 94 is formed with a generally rounded bottom 96 and an integral rounded end 98. The base 94 terminates upwardly in a flat elongated top surface 100, from which surface a plurality of randomly positioned elongated tines 102 integral extend. As best seen in FIG. 19, the tines 102 are randomly positioned upon the flat top surface 100 and are utilized for eyelash combing purposes. Preferably, the long tines 102 are similar in size, configuration and arrangement to the long tines 32 illustrated in FIGS. 12–14. The long tines 102 may be of stepped configuration 32 as illustrated on the left side of FIG. 3 or may be of elongated, slender, conical configuration 32' as illustrated on the right side of FIG. 3.

The molded plastic base 94 is provided about a portion of its rounded bottom periphery 96 with a plurality of longitudinally extending wells or slots 104, which wells extend from the connection to the wand 16 to terminate near the rounded front end or nose 98. The longitudinal wells 104 are utilized to remove a measured quantity of mascara from the bottle 12 and to apply the liquid cosmetic to the eyelashes in a manner which would tend to keep the lashes separate. The long tines 102 extend oppositely from the longitudinal wells 104 at right angles to the longitudinal axis of the base 94 and are employed for eyelash combing purposes in the manner hereinbefore set forth. After depositing measured quantities of mascara upon the eyelashes (not shown), the tines 102 can be utilized for combing purposes simply by rotating the wand 16 through approximately one hundred and eighty degrees.

Referring now to FIGS. 22, 23, 24 and 25, another embodiment of a mascara brush is illustrated wherein a molded plastic base 106 is formed with a generally rounded bottom 108 and wherein the base is securely affixed to the bottom end of the wand 16. The base is molded or is otherwise suitably formed to provide a flat top surface 110 and a flat bottom surface 112. As illustrated, a plurality of elongated tines 114, 114' integrally extend from the flat top surface 110 and are oriented generally at right angles to the longitudinal axis of the base 106 and to the plane of the top surface 110. The long tines 114, 114' are preferably formed to the same configuration, same cross sectional dimensions and the same length as the tines 36 or 36' illustrated in FIG. 3, but are randomly positioned instead of being arranged in rows.

Opposite the long tines 114, 114' are positioned a plurality of short tines 116. The short tines 116 are formed similarly to the short tines 48 illustrated in FIGS. 6 and 8 are similarly randomly positioned about the flat bottom surface 112. The short tines 116 are integrally molded with the base 106 and are oriented at right angles to the plane of the bottom surface 112. In the manner previously described in the embodiment of FIGS. 5–8, the short tines 116 are fabricated of uniform cross sectional configuration and are employed for mascara application purposes. A plurality of longitudinally extending wells or slots 118 are provided about the periphery of the base 106 for storing a measured quantity of mascara when the base 106 is removed from the bottle 12 for application to the eyelashes. At least some of the wells 118 continue forwardly and extend about the forward rounded rose 120 of the base 106 to enhance the mascara application capability. The longitudinal orientation of the wells 118 facilitates the storage and application of mascara without tending to group or bunch the lashes together.

Although the invention has been described with a certain degree of particularity, it is understood that the present disclosure has been made only by way of example and that numerous changes in the details of construction and the combination and arrangement of parts may be resorted to without departing from the spirit and scope of the invention.

What is claimed is:

1. A mascara applicator comprising an elongated plastic base having a planar top surface, a bottom surface, a longitudinal axis, a rearward end and a forward end;

a plurality of filament-like, plastic integral brush elements extending upwardly from the base top surface, the brush elements being positioned in rows arranged in parallel spaced relationship from the longitudinal axis;

the brush elements being integrally formed with the base and being integrally fabricated of the same plastic material as the material of the base to form a unitary structure, the brush elements being between about 0.010 and 0.018 inches in their largest cross sectional dimension, the brush elements each comprising a base and a tip, the brush elements being generally elongated in configuration and decreasing in their largest cross sectional dimension from their bases to their tips, a plurality of short plastic tines extending integrally downwardly from the bottom surface, the tines being randomly positioned on the bottom surface; and an elongated wand extending rearwardly from the rearward end of the base, the wand being of suitable length to facilitate the application of mascara.

2. The mascara application of claim 1 wherein the largest cross sectional dimension at the respective tips of at least some of the brush elements is approximately 0.005 inches and wherein the brush elements are of elongated, slender, conical configuration.

3. The mascara applicator of claim 1 wherein the individual brush elements comprise a base and a tip, the brush elements comprising at least three stepped diameter sections and wherein the section closest to the base has the greatest cross sectional dimension, the brush elements extending in length from the bases to the tips a distance of approximately 0.180 inches.

4. The mascara application of claim 1, wherein the short plastic tines are round in cross sectional configuration and wherein the brush elements are elliptical in their cross sectional configurations.

5. The mascara applicator of claim 4 wherein the short tines are fabricated of the same plastic material as the material of the base, the tines being shorter in length than the said brush elements, the short tines extending from the base in a direction opposite to the brush elements and the longest axes of the elliptical configuration of the tines being perpendicular to the longitudinal axis of the base.

* * * * *